US005636769A

United States Patent [19]

Willingham

[11] Patent Number: 5,636,769

[45] Date of Patent: Jun. 10, 1997

[54] NEGATIVE PRESSURE DISPENSE SYSTEM COMPRISING A DISPENSE ASSEMBLY AND MATEABLE COUPLING HEAD

[75] Inventor: John D. Willingham, Hull, United Kingdom

[73] Assignee: Royal Packaging Industries van Leer B.V., Amstelveen, Netherlands

[21] Appl. No.: 424,456

[22] PCT Filed: Oct. 28, 1993

[86] PCT No.: PCT/GB93/02222

§ 371 Date: Jun. 30, 1995

§ 102(e) Date: Jun. 30, 1995

[87] PCT Pub. No.: WO94/10081

PCT Pub. Date: May 11, 1994

[30] Foreign Application Priority Data

Oct. 30, 1992 [GB] United Kingdom ..... 9222886

[51] Int. Cl.[6] ..... B65D 83/00

[52] U.S. Cl. ..... 222/400.7; 222/402.1

[58] Field of Search ..... 222/481.5, 481, 222/400.7, 402.1, 402.25

[56] References Cited

U.S. PATENT DOCUMENTS 4,388,997 6/1983 Grime .

FOREIGN PATENT DOCUMENTS 1348654 3/1974 United Kingdom .

WO88/06693 9/1988 WIPO .

*Primary Examiner*—Gregory L. Huson

*Attorney, Agent, or Firm*—William R. Hinds

[57] ABSTRACT

A negative pressure dispense system comprises a dispense assembly to be fitted to a drum or other fluid container, and a coupling head to mate with the dispense assembly. The dispense assembly has an air valve to control the ingress of air to the fluid container and a fluid valve to control the egress of fluid from the fluid container. The coupling head seals solely with and opens the fluid valve. The dispense assembly and coupling head have complementary mating features that inter-engage upon relative mating movement between the dispense assembly and the coupling head. The dispense assembly fluid valve has a rotatable valve member, the coupling head has a part shaped to engage the rotatable valve member, and the dispense assembly and coupling head mating features inter-engage upon relative rotation whereby, in use, as the coupling head is rotated in the dispense assembly the mating features engage and the coupling head part engages and rotates the rotatable valve member to open the fluid valve.

8 Claims, 2 Drawing Sheets

Figure 1:
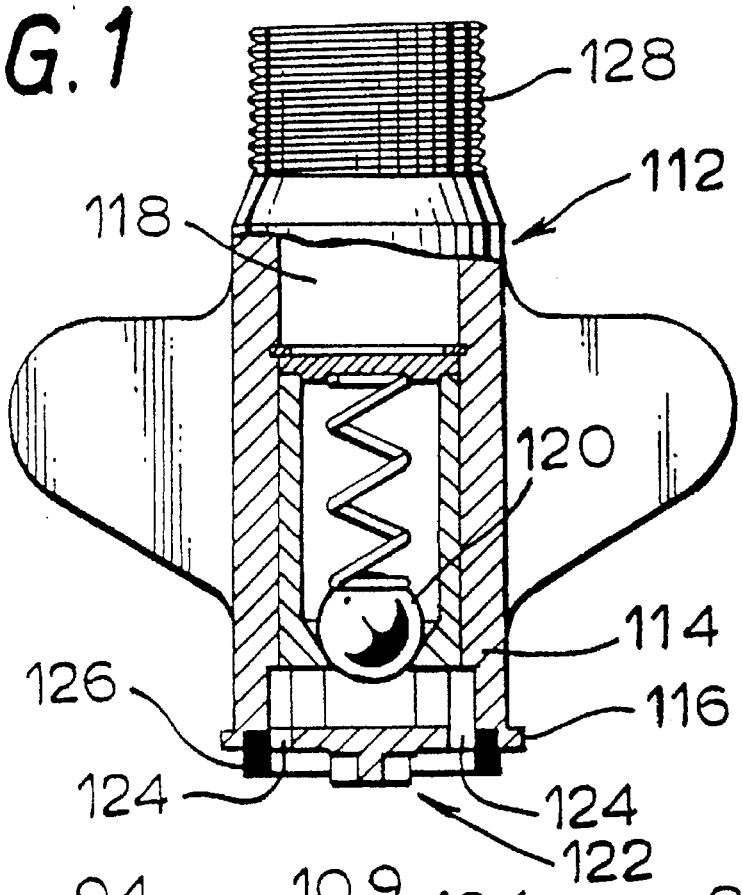
Figure 1:
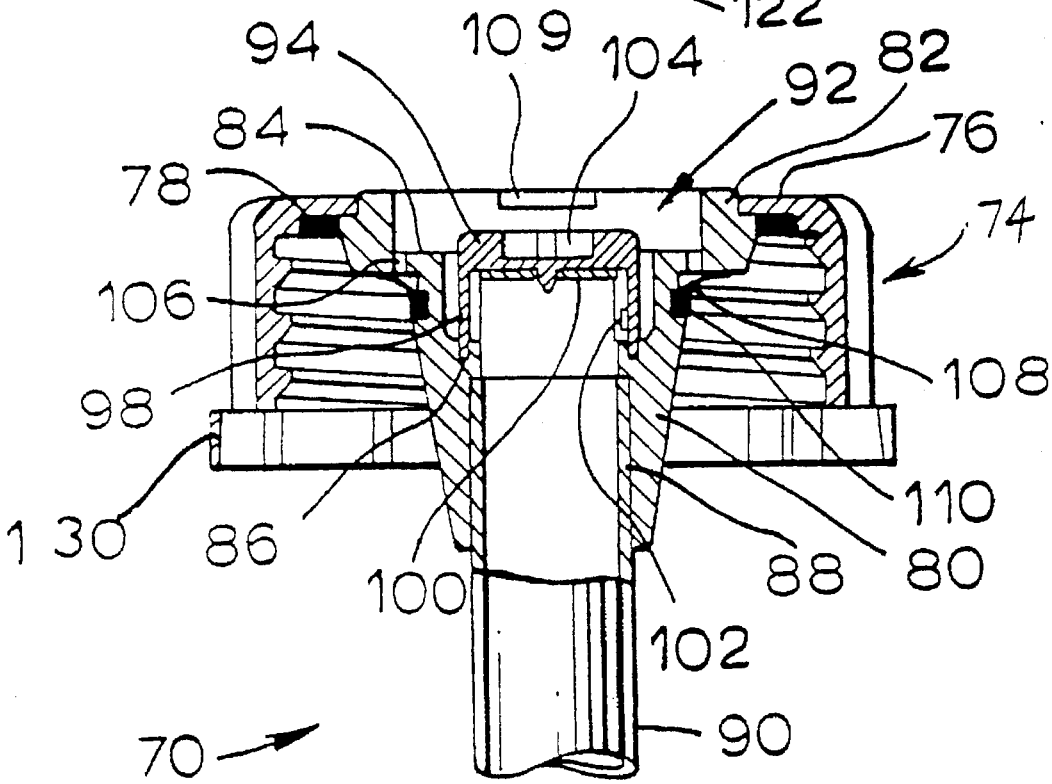

NEGATIVE PRESSURE DISPENSE SYSTEM COMPRISING A DISPENSE ASSEMBLY AND MATEABLE COUPLING HEAD

This invention relates to fluid couplings for negative pressure dispense systems and it particularly, but not exclusively, relates to fluid couplings that are suitable for use with drums for hazardous chemicals and the like.

There is a class of fluid dispense systems employing negative pressure dispensation of fluids from containers, such as expensive or hazardous liquid chemicals, the container being fitted with a dispense valve assembly that is to be mated with a coupling head at a point of use to enable the fluid to be pumped from the container. An example of a coupling for such a negative pressure dispense system is described in European Patent Specification No. EP-A-0 477 477 wherein the male assembly or coupling is fitted to the valve assembly by means of an attachment collar 27 slidingly received about the body 200 of the coupling 51 and having four attachment lugs 274; in use, the coupling is first fitted into the dispense valve, opening all the valves and only thereafter is the collar rotated to lock the valve in position. Such an arrangement is clearly dangerous in that hazardous chemicals could escape from an unsecured coupling.

It is an object of the present invention to provide a fluid coupling for negative pressure dispensing of fluids wherein the fluid valve cannot be opened without mating engagement between the coupling head and the dispense assembly.

According to the present invention, a fluid coupling for a negative pressure dispense system comprises a dispense assembly to be fitted to a drum or other fluid container, and a coupling head to mate with the dispense assembly, the dispense assembly having an air valve to control the ingress of air to the fluid container and a fluid valve to control the egress of fluid from the fluid container, the coupling head sealing solely with and opening the fluid valve, and the dispense assembly and coupling head having complimentary mating features that inter-engage upon relative, mating movement between the dispense assembly and the coupling head, wherein the dispense assembly fluid valve has a rotatable valve member, the coupling head has a part shaped to engage the rotatable valve member, and the dispense assembly and coupling head mating features inter-engage upon relative rotation, whereby, in use, as the coupling head is rotated in the dispense assembly the mating features engage and the coupling head part engages and rotates the valve member to open the fluid valve.

In an embodiment of the present invention, the rotatable valve member is of an inverted cup shape having radial ports in the cup side walls and is rotatable about a vertical axis on a valve support member that is part of the dispense assembly and is provided with radial ports that communicate with a through bore in the valve support member; whereby, in use, the valve member can be rotated so that its ports register with the support member ports to open the fluid valve.

Preferably, the rotatable valve member has a cruciform depression in its upper surface and the coupling head terminates in a central cruciform extension comprising said part shaped to engage the rotatable valve member. The coupling head may have a through bore housing a one-way fluid valve and the cruciform extension may have surrounding axial ports communicating with the one-way valve.

Figure 2:
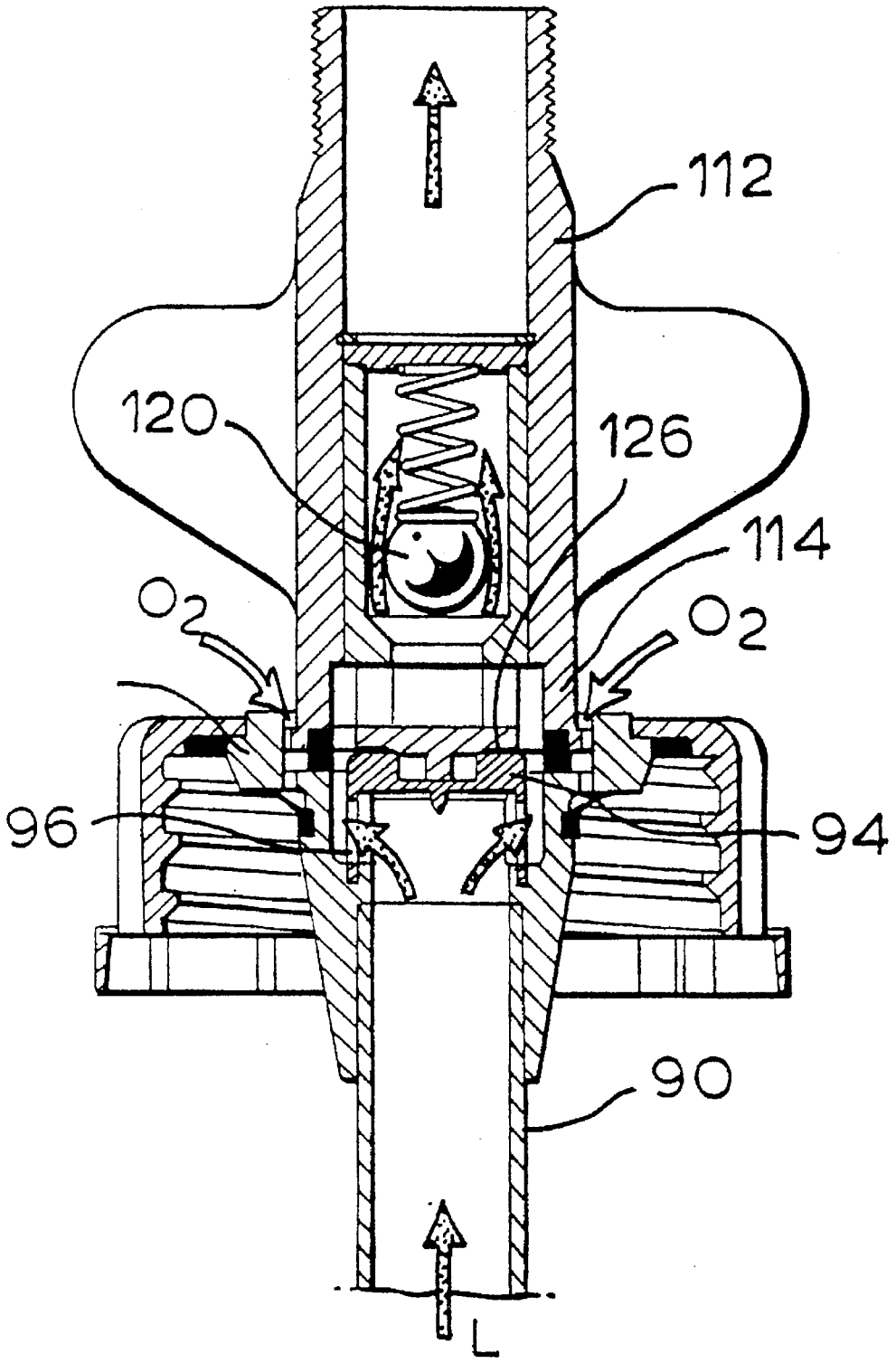

The above and other features of the present invention are illustrated, by way of example in the Drawings, wherein:

FIG. 1 is a sectional elevation of an unmated coupling head and dispense cap in accordance with a first embodiment of the present invention; and, FIG. 2 is a similar view of the coupling head and dispense cap of FIG. 1, when mated.

The fluid coupling shown by FIGS. 1 and 2 generally comprises a dispense cap 70 and a coupling head 112. The dispense cap is a plastics moulding of generally conventional cap shape, or it could be an adapted cap, with a depending threaded skirt 74, a top 76 and a cap seal 78 to seal against the lip of the neck of a container or drum (not shown), for example a type 2001 plastic drum). A frusto-conically shaped socket 80 is co-axially, sealingly fitted into the cap top. The top of the socket is provided with a radially outwardly extending flange 82 that is attached to the cap top. The socket also has a central recess 84 and a bore 86 running from the bottom of the recess to the inner end 88 of the socket body. The lower part of bore 86 is of larger diameter than the upper part and a plastics tube 90 is fitted within the lower bore and depends to the bottom of the drum. The socket duct is sealed by a fluid valve 92 having a rotary valve member 94. The valve member is of an inverted cup shape having radial ports 96 (FIG. 2) in the cup side walls 98 and can rotate about a vertical axis on a valve support member 100, part of the socket body 80, that is provided with radial ports 102 (FIG. 1) that communicate with the through bore 86. Valve member 94 can be rotated so that its ports 96 can register with the support member's ports 102, i.e. the fluid valve will be open (FIG. 2). The valve is closed when the valve seal is rotated away from port registration (FIG. 1). Valve member 98 also has a cruciform depression 104 in its upper surface.

A ring of air holes 106 in the bottom of the recess 84 surround the bore 86, running axially from the recess to emerge under the socket flange 82. A resilient, annular air valve diaphragm 108 is seated in a peripheral groove 110 about the exterior of the socket body and is biassed against the underside of the socket flange to thereby normally seal the air holes 106. The socket recess 84 is also provided with a pair of circumferentially short, radially inwardly extending flanges 109.

The coupling head 112 generally comprises a radially winged, cylindrically shaped moulding of plastics material the front end 114 of which is provided with circumferentially short, radially outwardly extending flanges 116 that are designed to inter engage in a bayonet type fitting with the inwardly extending flanges 109 in the dispense cap central recess 84. The coupling head has a through bore 118 that terminates in a larger diameter bore. A spring-loaded, non-return ball valve 120 is housed in the larger diameter bore. The coupling head terminates in a central cruciform extension 122; with surrounding axial ports 124 communicating with non-return ball valve 120. A sealing ring 126 is provided at the coupling head front end radially outside the axial ports 124. The upper end of the coupling head is threaded at 128 for connection to an outlet pipe, not shown.

In use, the coupling head 112 is mated to the dispense cap 70 by introducing the coupling head 114 front end into the cap socket recess 84 and rotating the coupling head a part-turn relative to the dispense cap so that the coupling head bayonet flanges 116 engage under the dispense cap socket bayonet flanges 109. As the coupling head enters the dispense cap socket, the coupling head cruciform extension 122 enters fluid valve member cruciform depression 104 and, as the coupling head 112 is rotated, valve member 94 is rotated from its closed to its opened position. Sealing ring 126 is compressed against the bottom of the socket recess 84 to seal the coupling head front end in the dispense cap socket. A suction pump (not shown) is connected to the coupling head upper end 128 so that L can be pumped out of the drum; passing up tube 90, through the fluid valve ports 102 & 96, through axial ports 124 up into the coupling head front end 114, past the ball valve 120 to the outlet from the coupling head (as indicated by the arrows in FIG. 2). As pressure in the drum drops air will pass the coupling head front end 114, between the coupling head flanges 116, to flow through the air holes 106 into the head space in the drum; the differential air pressure lifting air valve diaphragm 108 off the underside of the socket flange (again as indicated by the arrows in FIG. 2). The cap skirt 74 may be provided with an anti-tamper ring 130 of known type and the cap socket recess 84 may be provided with a transit bung (not shown).

I claim:

1. A negative pressure dispense system comprising a dispense assembly to be fitted to a fluid container, and a coupling head to mate with the dispense assembly, the dispense assembly having an air valve to control the ingress of air to the fluid container and a fluid valve to control the egress of fluid from the fluid container; the coupling head sealing solely with and opening the fluid valve; and the dispense assembly and coupling head having complimentary mating features that inter-engage upon relative, mating movement between the dispense assembly and the coupling head, wherein the dispense assembly fluid valve has a rotatable valve member, the coupling head has a part shaped to engage the rotatable valve member, and the dispense assembly and coupling head mating features inter-engage upon relative rotation; whereby, in use, as the coupling head is rotated in the dispense assembly the mating features engage and the coupling head part engages and rotates the rotatable valve member to open the fluid valve.

2. A system as claimed in claim 1 wherein the rotatable valve member is of an inverted cup shape having radial ports in the cup side walls and is rotatable about a vertical axis on a valve support member that is part of the dispense assembly and is provided with radial ports that communicate with a through bore in the valve support member; whereby, in use, the valve member can be rotated so that its ports register with the support member ports to open the fluid valve.

3. A system as claimed in claim 2 wherein the rotatable valve member has a cruciform depression in its upper surface and the coupling head terminates in a central cruciform extension comprising said part shaped to engage the rotatable valve member.

4. A system as claimed in claim 3 wherein the coupling head has a through bore housing a one-way fluid valve and the cruciform extension has surrounding axial ports communicating with the one-way valve.

5. A system as claimed in claim 2 wherein the dispense assembly and the coupling head have part-turn, inter-engaging fittings.

6. A system as claimed in claim 5 wherein the part-turn, inter-engaging fittings are bayonet fittings.

7. A system as claimed in claim 1 wherein the air ingress valve is a one-way valve provided in the dispense assembly co-axially with the fluid valve.

8. A system as claimed in claim 7 wherein the one-way valve is an annular air valve diaphragm disposed about the fluid valve and biased to seal air inlet ports in the dispense assembly.

* * * * *